US005226794A

United States Patent [19]

Ziehl et al.

[11] Patent Number: 5,226,794

[45] Date of Patent: Jul. 13, 1993

[54] FUEL INJECTION PUMP FOR INTERNAL COMBUSTION ENGINES

[75] Inventors: Manfred Ziehl, Homburg; Josef Guentert, Gerlingen; Manfred Wilhelm, Nussdorf, all of Fed. Rep. of Germany

[73] Assignee: Robert Bosch GmbH, Stuttgart, Fed. Rep. of Germany

[21] Appl. No.: 812,478

[22] Filed: Dec. 23, 1991

[30] Foreign Application Priority Data

Dec. 22, 1990 [DE] Fed. Rep. of Germany ..... 4041503

[51] Int. Cl.[5] ..... F04B 7/04; F02M 59/20

[52] U.S. Cl. ..... 417/499; 417/289; 123/503

[58] Field of Search ..... 417/490, 494, 499, 289; 123/495, 501, 503, 500

[56] References Cited

U.S. PATENT DOCUMENTS 4,811,716 7/1989 Guntert ..... 123/503
4,842,497 6/1989 Hafele ..... 123/495

FOREIGN PATENT DOCUMENTS 4023507 3/1991 Fed. Rep. of Germany ..... 123/495
2188103 3/1987 United Kingdom ..... 123/495
87/05970 10/1987 World Int. Prop. O. ..... 123/495

*Primary Examiner*—Richard A. Bertsch
*Assistant Examiner*—Roland McAndrews
*Attorney, Agent, or Firm*—Edwin E. Greigg; Ronald E. Greigg

[57] ABSTRACT

A fuel injection pump having a pump piston in a bore of a pump cylinder, wherein the pump piston is rotatable for fuel control, and having a niche disposed in the pump cylinder for receiving a control slide, wherein the niche can be made by non-cutting shaping. The niche has a flat niche bottom, which changes into two oblique niche walls, which extend in two straight parallel niche walls facing one another, these parallel niche walls in turn, change into oblique faces and terminate in slideways, in which the control slide is guided against twisting by slide runners that simultaneously act as impact aprons. The niche is embodied by non-cutting shaping in such a way that its wall thickness relative to the cylindrical outer shape of the pump cylinder is embodied as virtually constant.

4 Claims, 3 Drawing Sheets

FUEL INJECTION PUMP FOR INTERNAL COMBUSTION ENGINES

BACKGROUND OF THE INVENTION

The invention is based on a fuel injection pump for internal combustion engines.

Every pump cylinder of this kind of fuel injection pump must have a recess or niche to receive the control slide, which weakens the overall stability of the pump cylinder and has disadvantages in the event that deformation or slight changes occur during installation of the pump cylinder in the pump housing between the flange and the lower support from tolerance errors, in which case the pump piston guided on either side of this niche in the pump cylinder will no longer slide exactly in alignment. This occurs especially in fuel injection pumps of the kind in which the niche is embodied as an opening or window that penetrates the pump cylinder (German Offenlegungsschrift 34 28 174). Only two connecting pieces remain standing to absorb the axial forces here; the axial forces can be transmitted only via these connecting pieces, and torsion or twisting cannot always be precluded.

However, there are also fuel injection pumps of this generic type (European Patent 0 181 402, FIG. 4), in which the pump cylinder is in two parts, and the niche is produced by axial shaping by metal cutting. Both parts are then joined together again by suitable methods, such as shrinkage or hard soldering, so that the niche is axially closed again by the other part of the pump cylinder. This creates a niche that is open on three sides; the open side is necessary so that the control slide can be engaged by a suitable adjuster in order to adjust it axially on the pump piston. This structural embodiment of the niche has relatively high stability to torsion and twisting of the pump cylinder during installation, but it is very complicated and expensive to manufacture.

Recesses and niches that can be obtained by milling have also been proposed. Once again, however, the complicated production process entails relatively high costs.

OBJECT AND SUMMARY OF THE INVENTION

The fuel injection pump according to the invention has the advantage over the prior art that high stability is attained, which has a favorable effect in terms of increasing the service life, even though the production process for manufacturing the pump cylinder is simple and inexpensive.

In an advantageous feature of the invention, the internal shape of the niche in the pump cylinder is embodied such that a virtually constant wall thickness, adapting to the outer shape of the pump cylinder, is attained.

In another advantageous feature of the invention, the face ends of the niche, one of which is toward the drive cam of the pump piston and the other is toward the pump work chamber, are slightly curved or rounded, for manufacturing reasons.

An especially advantageous further development of the invention is attainable as set forth herein, a favorable embodiment of the pump piston and control slide from a production standpoint, and an improvement in fuel flow and protection against cavitation, that is, "impact protection", are also attainable. By means of this advantageous embodiment, the niche is made only precisely large enough as necessary for the control slide, so that the remaining wall can optimally take on support forces, and a gap for the diverted fuel stream that is sufficient for control and filling processes inside the niche is created between the control slide and the pump piston.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
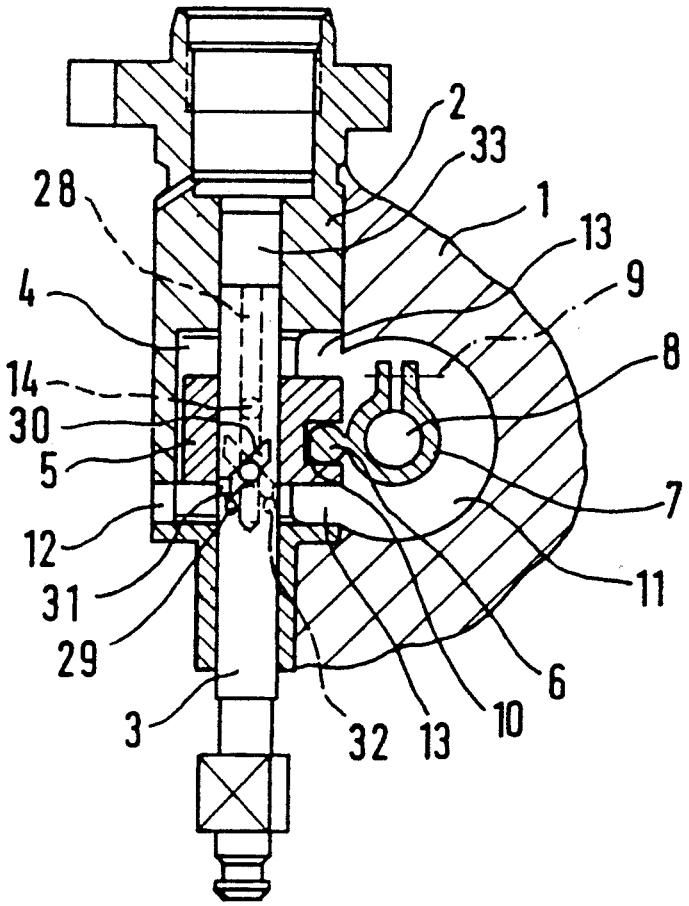
FIG. 1 is a fragmentary longitudinal section through the fuel injection pump according to the invention.

In the fuel injection pump shown in FIG. 1, a pump cylinder 2 is inserted in a pump housing 1, which is shown only in part; in the pump cylinder, a pump piston 3 is set into reciprocating motion by means not shown in FIG. 1. A niche 4 made by non-cutting shaping techniques is disposed in the pump cylinder 2 to receive a control slide 5, which can be displaced on the pump piston 3 to control the injection onset. The axial displacement of the control slide 5 on the pump piston 3 is effected for instance via a ball-shaped protrusion 6, which is disposed on a rider 7, which in turn is seated on a control rod 8 and is secured adjustably by a screw 9; the protrusion 6 engages a slit 10 of the control slide 5. In in-line pumps, a plurality of such riders, corresponding in number to the number of pump elements 2 and 3, are secured on the control rod 8 and actuate the control slide 5.

The control rod 8 having the riders 7 is disposed in the pump suction chamber 11, which is supplied with fuel by a feed pump from a fuel tank through a throughbore 12 provided on the lower end of the niche 4 in the pump cylinder 2. It is also possible, however, to supply the pump suction chamber 11 with fuel in some other way.

The niche 4 s made to communicate with the pump suction chamber 11 through accesses 13, so that an open communication always exists, and the niche 4 is always filled with fuel. In the control slide 5, which is shown in detail in FIGS. 4, 4*a*, 4*b* and 4*c*, a diversion bore 14 is provided which intersects the bore which receives the pump piston and the diversion bore is provided with flat end clearances 15 on each end. The clearances 15 change into a radial part 16, which in turn forms a gap 18 with respect to the inner shape of the niche 4. Slide runners 19 are disposed above the clearances 15 on both ends of the control slide 5 and with their side 20 toward the niche 4 they function as impact aprons 21.

Figure 3:
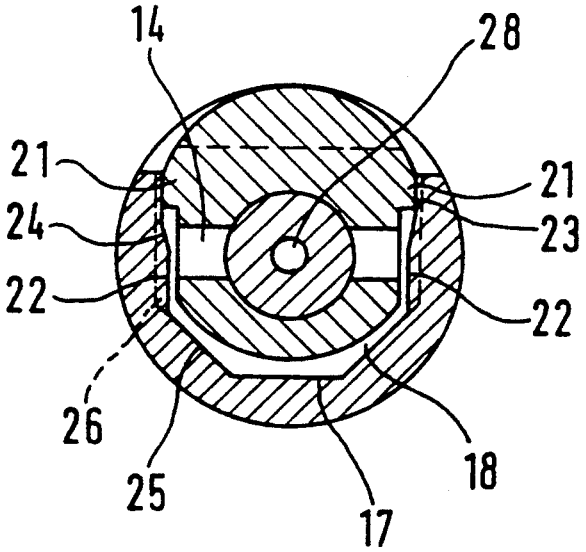
FIG. 3 is a section through the pump cylinder according to the invention, with the control slide disposed in it.
Figure 2A:
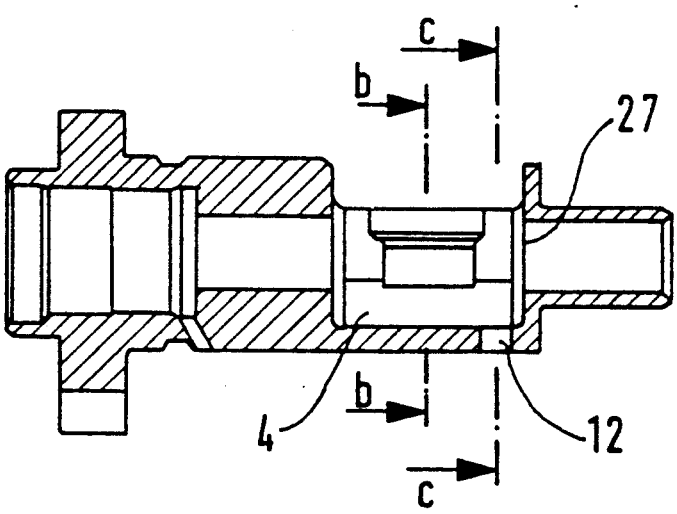
FIGS. 2 and 2*a* through 2*c* are a side view and several sectional views through the pump cylinder according to the invention.
Figure 2:
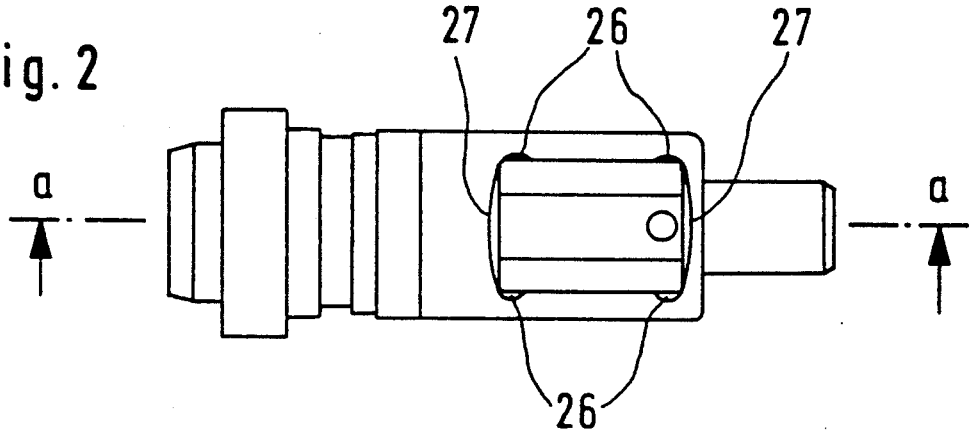
Figure 2B:
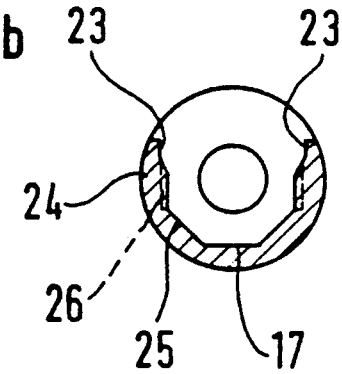
Figure 2C:
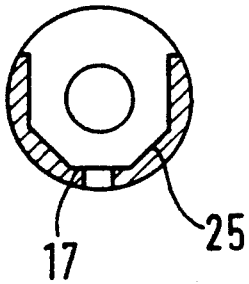
Figure 4A:
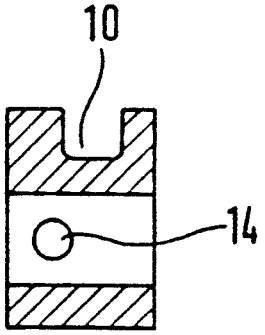
FIG. 4 along with FIGS. 4*a* through 4*c* are a plan view, two sectional views and a side view of the control slide, respectively.
Figure 4:
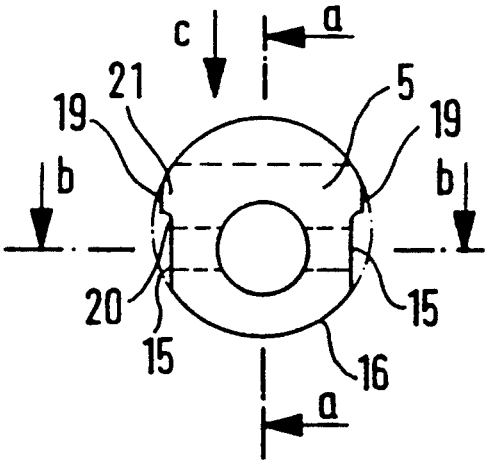
Figure 4B:
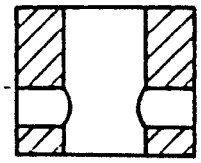
Figure 4C:
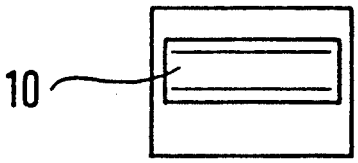

In FIGS. 2 and 2*a* through 2*c*, which show the niche 4 in detail, it can be seen that slideways 23 are disposed on the upper part of the straight walls 22 of the niche; the slideways are embodied as wider than the width of the slide runners 19 on the control slide 5. The slideways 23 on both ends change into oblique planes 24 in the direction of the bottom 17 of the niche, and these planes in turn change into the straight walls 22 of the niche and which together with the oblique niche walls 25 and the niche bottom 17 and the radial part 16 of the control slide 5 produce the aforementioned gap 18 (FIG. 3).

Radial clearances 26, which determine the length of the slideways 23 and enable them to be dimensionally precisely fine-machined, are disposed on both ends of the slideways 23 approximately up to the transition between the oblique niche walls 25 and the straight niche walls 22. The two end walls 27 of the niche 4 are slightly radially shaped down to the niche bottom 17, for manufacturing reasons.

An axial bore 28 which is intersected by a transverse bore 29 with opposed oblique grooves 30, the grooves being engaged by recesses 31, is provided in the pump piston 3. A further transverse bore 32, which likewise intersects the axial bore 28, is provided below the transverse bore 29. Thus a pump work chamber 33 communicates with the pump suction chamber 11 via the axial bore 28, the transverse bore 29 with its oblique groove 30 and recesses 31, the transverse bore 32, and the diversion bore 14, via the gap 18 and the niche 4 and through the accesses 13.

The exemplary embodiment shown functions as follows: A camshaft, not shown in the drawings, sets the pump piston 3 into reciprocating motion, counter to the force of a spring. An adjusting device, not shown, rotates the pump piston 3 to control the injection quantity in the pump cylinder 2 and in the control slide 5. In accordance with the rotation in the control slide 5 of the pump piston 3 with the transverse bore 29, where the oblique grooves 30 engage the recesses 31, the thus-defined spacing of the oblique grooves 30 and recesses 31 from the diversion bore 14 disposed in the control slide 5 is variable, which correspondingly means a variably long injection stroke. The control rod 8 disposed in the pump suction chamber 11, with its rider 7 and the ball-like protrusion 6, engages the slit 10 of the control slide 5 and thus moves the control slide 5 axially on the pump piston 3, whereupon the injection onset is defined. From the pump suction chamber 11, via the accesses 13 and the niche 4, which surrounds the control slide 5, and via the transverse bore 32 and the axial bore 28 of the pump piston 3, the pump work chamber 33 is filled with fuel. In the compression stroke of the pump piston 3, fuel flows via the axial bore 28 and transverse bore 32 into the niche 4 and via the accesses 13 back into the pump suction chamber 11 until the transverse bore 32 has entered the control slide 5. At that instant, the high-pressure injection of the fuel to the engine begins. The onset of high-pressure injection is accordingly dependent on the particular reciprocal position of the control slide 5 on the pump piston 3.

If the oblique grooves 30 with their recesses 31 are opened by the diversion bore 14 of the control slide 5, the high-pressure injection is interrupted, and the fuel, which is at high pressure in the pump work chamber 33, shoots via the axial bore 28, transverse bore 29 and oblique grooves 30 and through the diversion bore 14 into the gap 18. The control slide 5, which is guided precisely counter to twisting by its slide runners 19 in the slideways 23 of the niche 4, seals off the direct access to the pump suction chamber 11 with its impact aprons 21, and with the niche bottom 17, oblique niche walls 25 and inclined planes 24 and the straight niche walls 22, together with the clearances 15 and the radial part 16 of the control slide 5 toward the niche bottom 17, forms the aforementioned gap 18. In this gap 18, the fuel stream is reflected before it flows back to the pump suction chamber 11 above or below the control slide 5 via the accesses 13. The slide runners 19 disposed on the control slide 5 accordingly have two functions. First, they serve to guide the control slide 5, and second, they serve as an impact apron 21 against the fuel shooting out of the diversion bore 14 at high pressure. The unbraked access of the fuel stream to the pump suction chamber 11 is thus prevented, because the energy present in the fuel stream is reduced and cavitation and erosion damage in the interior of the fuel pump is avoided.

Instead of the guidance of the control slide 5 by slide runners 19, the control slide may also have a protruding guide part in a known manner, which is integral with the control slide or secured to it and protrudes into an oblong slot in the niche bottom 17. This oblong slot then replaces the throughbore 12 and has a semicircular boundary on its axial ends.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines, including a housing, a pump cylinder in said pump housing, said pump cylinder including a piston bore, a pump piston in said piston bore, the pump piston is driven for a reciprocating working stroke and is rotatable to control fuel flow from a pump suction chamber (11), at least one control slide axially displaceable on the pump piston inside a niche in the pump cylinder, a bottom (17) of said niche is formed by a flat adjacent surface and two oblique flat niche walls (25) which are symmetrical to a plane through the axis of said pump piston and normal to said bottom (17), said two oblique flat niche walls (25), extend to two straight parallel niche walls (22) facing one another wherein the thickness of the walls of the niche (4) is embodied as approximately constant, and that the straight niche walls (22) extend toward an opening of the niche to the suction chamber (11) and change again into oblique outwardly inclined surfaces (24), which in turn terminate in slideways (23) on which two safety protrusions (19) on opposite sides of the control slide (5) embodied as slide runners slide, said protrusions simultaneously serve as impact aprons and cut off a gap (18) between the niche (4) and the control slide (5) from the pump suction chamber (11), and the niche (4) is provided for receiving the control slide (5) in the pump cylinder (3) and is made by a non-cutting shaping technique.

2. A fuel injection pump as defined by claim 1 in which the axial end walls (27) of niche (4) have a slightly curved shape being symmetric to said plane through the axis of the pump piston.

3. A fuel injection pump as defined by claim 1, in which the slideways (23) have radial clearances (26) on their ends, which clearances extend in depth as far as a transition from the oblique niche walls (25) to the straight niche walls (22).

4. A fuel injection pump as defined by claim 3, in which axial end walls (27) of the niche (4) have a slightly curved shape being symmetric to said plane receiving the axis of the pump piston.

* * * * *